US005842595A

United States Patent [19]

Williams

[11] Patent Number: 5,842,595

[45] Date of Patent: Dec. 1, 1998

[54] MOBILE TRASH/GARBAGE BAG HOLDER WITH OPEN BOTTOM

[76] Inventor: Dale L. Williams, 12041 Captains Landing, N. Palm Beach, Fla. 33408

[21] Appl. No.: 954,730

[22] Filed: Oct. 20, 1997

[51] Int. Cl.[6] ..... B65D 1/06

[52] U.S. Cl. ..... 220/495.11; 220/495.08; 220/495.04; 220/908.1; 220/908; 248/98; 248/99; 280/47.26; 280/47.24; 280/47.17

[58] Field of Search ..... 220/495.11, 495.08, 220/495.04, 908, 908.1; 248/98, 99; 280/47.26, 47.24, 47.17

[56] References Cited

U.S. PATENT DOCUMENTS 3,771,752 11/1973 Meeh .
4,167,271 9/1979 Jorgensen .
4,222,580 9/1980 Krokonko .
4,280,676 7/1981 Betts .
4,457,483 7/1984 Gagne .
4,705,246 11/1987 Wolf .
4,953,744 9/1990 Koyama .
5,062,871 11/1991 Lemon, III .
5,597,022 1/1997 Reifers .

*Primary Examiner*—Stephen J. Castellano

[57] ABSTRACT

The Easy Trash Bagger is a yard maintenance tool used to bag yard trash in disposable plastic trash bags. It is a reusable trash container that supports the bag in an upright and open position for trash loading, protects the bag from tears and ruptures during trash loading and compaction, allows the easy removal of the heavy and cumbersome filled bag from the trash container, and transports the heavy and cumbersome filled bag to the street curb for disposal by trash haulers. Indoors, it may also be used to bag household garbage in a similar manner.

1 Claim, 3 Drawing Sheets

MOBILE TRASH/GARBAGE BAG HOLDER WITH OPEN BOTTOM

FIELD OF THE INVENTION

The Easy Trash Bagger is a yard maintenance tool used to bag yard trash in disposable plastic trash bags. It is a reusable trash container that supports the bag in an upright and open position for trash loading, protects the bag from tears and ruptures during trash loading and compaction, allows the easy removal of the heavy and cumbersome filled bag from the trash container, and transports the heavy and cumbersome filled bag to the street curb for disposal by trash haulers. Indoors, it may also be used to bag household garbage in a similar manner.

1. Background of the Invention

REFERENCES TO PREVIOUS PATENTS

1. U.S. Pat. No. 3,915,329: Zaks, Oct. 28, 1975
2. U.S. Pat. No. 4,031,689: Sullivan, Jun. 28, 1977
3. U.S. Pat. No. 4,037,778: Boyle, Jul. 26, 1977
4. U.S. Pat. No. 4,267,996: Turcott, May 19, 1981
5. U.S. Pat. No. 4,628,007: Ledsham, Dec. 9, 1986

2. Description of Related Devices

Disposable plastic trash bags are useful and economical for the retention and disposal of yard trash. For economics, the bags are constructed of a thin plastic film (approximately 0.001 inch thick). The flimsy construction creates two problems in the use of these bags.

Problem 1: The plastic trash bag is not self-supporting in an upright and open position for trash loading. It must be held open with one hand while the other hand loads the trash into the bag which is not an easy task.

Problem 2: The plastic trash bag is prone to tears and ruptures during trash loading and compaction.

Different types of bag holding devices have been developed to address these problems.

Type 1 Bag Holder: References 2 and 4 describe an external open frame stand to support the plastic trash bag in an upright and open position for trash loading. However, open frame stands do not protect the bag from tears and ruptures during trash loading and compaction.

Type 2 Bag Holder: References 1, 3 and 5 describe an insert within the plastic trash bag to support it in an upright and open position for trash loading. The insert protects the bag from tears and ruptures during trash loading and compaction.

Type 3 Bag Holder

The household garbage can is used as a plastic trash bag holder. The bag is inserted into the garbage can and is stretched over the top rim. The garbage can supports the bag in an upright and open position for trash loading. The solid walls of the garbage can prevent the bag from over-expanding and protect the bag from tears and ruptures during trash loading and compaction. Based on the large numbers of type 3 devices, it must offer the user significant advantages in bagging trash over types 1 and 2 devices. However, the garbage can has its own unique problems which are described below.

When a plastic trash bag is inserted into a garbage can and the bag is stretched over its top rim, air is trapped between the garbage can and bag. As trash is loaded into the bag, the trapped air prevents filling the bag to more than 50 percent capacity. To release the trapped air, the bag must be removed from the top rim, pushed against the sides of the garbage can, and re-stretched over the top rim. These actions to release the trapped air are time consuming.

When the plastic trash bag is full, the bag is removed from the top rim. The bag is closed with a bag tie or left open. The heavy and cumbersome filled bag must be pulled out of the garbage can. As the bag is pulled and begins to lift, a vacuum is created between the bag and garbage can which makes the bag cling to the garbage can. While the filled bag is heavy, the force to break the vacuum is tremendous. The only way to break the vacuum is to pull and work the bag back-and-forth with both hands to try to break the vacuum while trying to hold the garbage can down with both legs. This ordeal to remove the bag is both back-breaking and time consuming.

SUMMARY OF THE INVENTION

The Easy Trash Bagger is a yard maintenance tool used to bag yard trash in disposable plastic trash bags. It is a reusable trash container that supports the bag in an upright and open position for trash loading, protects the bag from tears and ruptures during trash loading and compaction, and allows the easy removal of the heavy and cumbersome filled bag from the trash container, and transports the heavy and cumbersome filled bag to the street curb for disposal by trash haulers. Indoors, it may also be used to bag household garbage in a similar manner.

A complete description of the Easy Trash Bagger is provided under Detailed Description of the Drawings. A brief description of the Easy Trash Bagger follows:

The tubular frustum container (1) has an open base with reinforced rim (2) and an open top with reinforced rim (3). Once a plastic trash bag is inserted into the container (1) and is stretched over the top rim (3), the snap-on lid (4) seals the contents within the bag. An adjustable handle (5) and a pair of wheels (6) allow the Easy Trash Bagger with its heavy and cumbersome filled bag to be pulled to the street curb where the bag is removed and left for disposal by trash haulers. Construction materials are heavy duty plastic and a metal axle for the wheels.

A description of the use of the Easy Trash Bagger follows

The Easy Trash Bagger is pulled to the work area using the adjustable handle (5). The snap-on lid (4) is removed.

A bag is inserted into the container (1) so that the bag's top is stretched over the top rim (3) and the bag's bottom rests on the ground. Therefore, the bag is supported in an upright and open position for trash loading.

As the bag is filled, the bag expands and the air between the bag and the container (1) automatically escapes through the open base (2). Therefore, the need to manually release the trapped air which occurs when using a garbage can is eliminated. The bag's bottom is supported by the ground and the bag's sides are supported by the container (1). Therefore, the bag is protected from tears and ruptures during loading and compaction.

Once the bag is filled, the Easy Trash Bagger is pulled using the adjustable handle (5) to the street curb for unloading. The bag is slipped from the top rim (3). The bag is closed with a bag tie or left open. The lip of the top rim (3) is used to lift the "light" Easy Trash Bagger, and the heavy and cumbersome filled bag remains on the ground ready for disposal by trash haulers. Therefore, the back-breaking and time consuming ordeal to remove the bag from the container which occurs with the garbage can is eliminated.

DETAILED DESCRIPTION OF THE DRAWINGS

Figure 1:
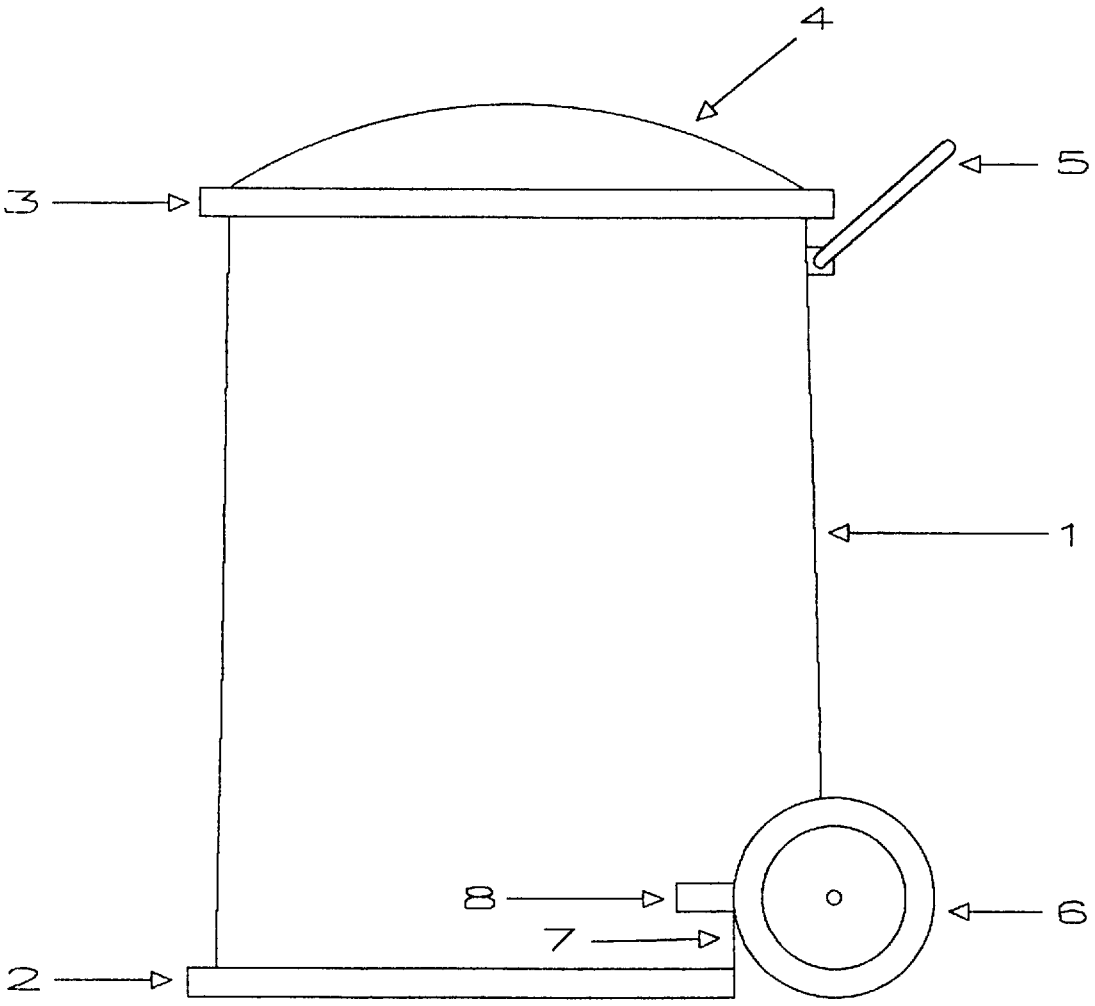
FIG. 1 is a side view of the Easy Trash Bagger.
Figure 2:
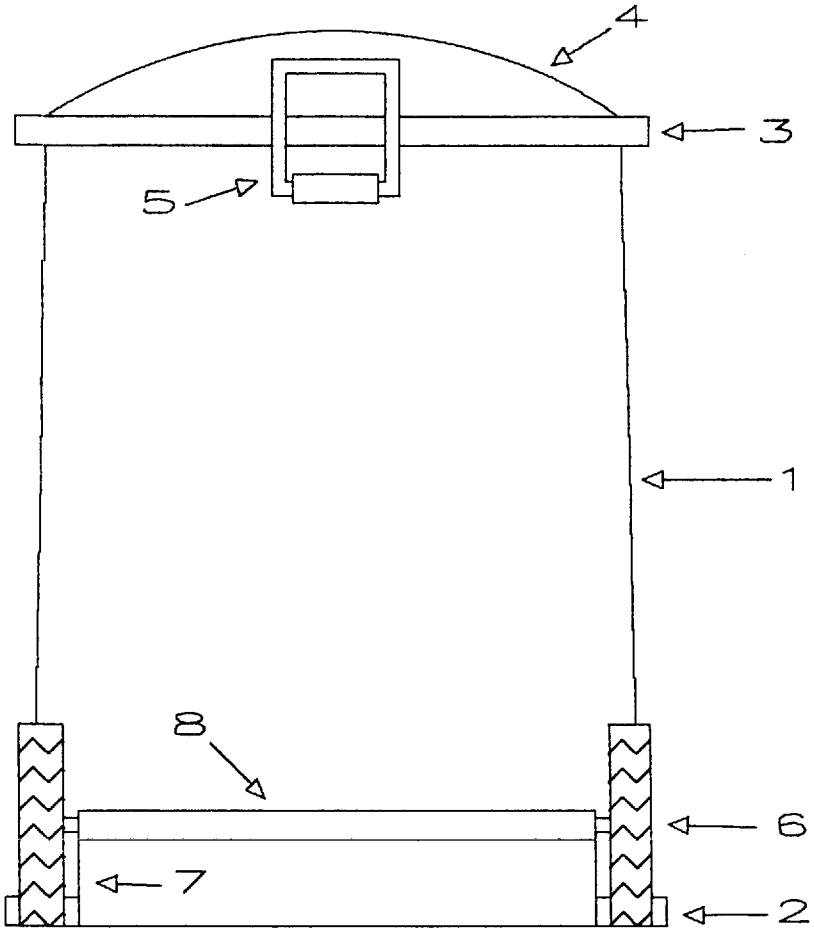
FIG. 2 is a back view of the Easy Trash Bagger.
Figure 3:
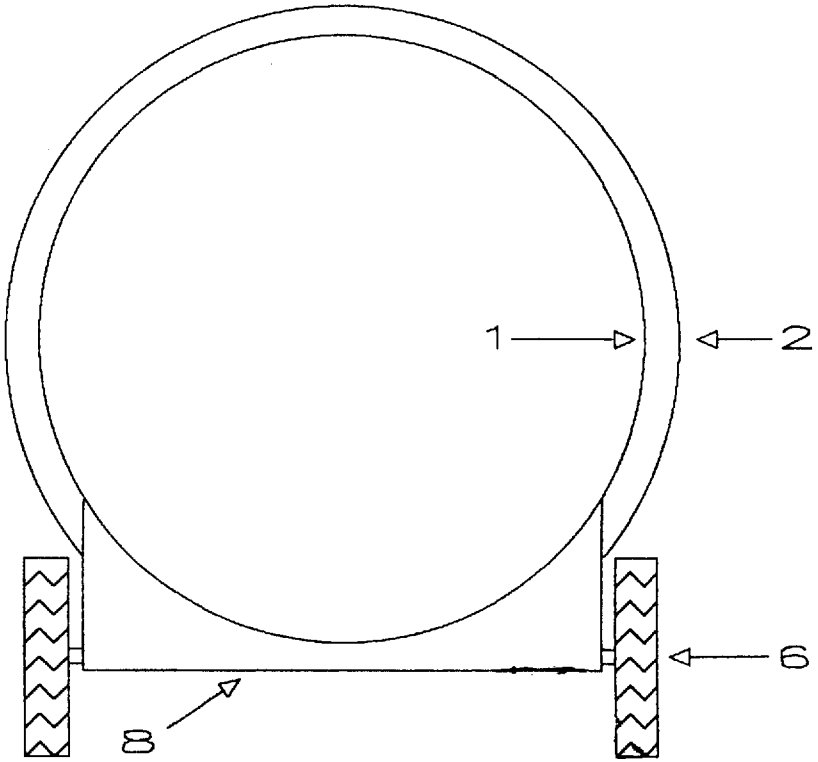
FIG. 3 is a bottom view of the Easy Trash Bagger.

The components for the Easy Trash Bagger are shown in FIGS. 1 through 3. Design features and their benefits are defined below:

FIG. 1 is a side view of the Easy Trash Bagger. The tubular frustum container (1) has an open base with reinforced rim (2), an open top with reinforced rim (3), a snap-on lid (4), an adjustable handle (5), and a pair of wheels (6).

1. The top rim's inner diameter is approximately one inch smaller than the diameter of a standard plastic trash bag while the top rim's outer diameter is approximately one inch larger. After the bag is inserted into the container, these design features allow the bag to be stretched over the top rim and provide the following benefits: (a) the container supports the bag in a upright and open position for trash loading, and (b) the heavy and cumbersome filled bag is secured within the container during the transportation of the bag.
2. The top rim's inner diameter is approximately one inch smaller than the diameter of a standard plastic trash bag;

the base rim's inner diameter is approximately equal to the diameter of a standard bag; the height of the container is a few inches shorter than the length of a standard bag. These design features provide the following benefits: (a) the container supports the sides of the filled bag and protects the sides of the bag from tears and ruptures during trash loading and compaction, (b) the ground supports the bottom of the filled bag and protects the bottom of the bag from tears and ruptures during trash loading and compaction, and (c) the full capacity of the bag may be utilized because the container is approximately the size of a standard bag.

3. The base rim's inner diameter is larger than the top rim's inner diameter. This design feature allows the easy removal of the heavy and cumbersome filled bag through the open base. The "light" Easy Trash Bagger is lifted up and away from the filled bag, and the filled bag remains on the ground.
4. The lip of the reinforced top rim serves as handles. This design feature allows the "light" Easy Trash Bagger to be lifted up and away from the heavy and cumbersome filled bag.
5. After a plastic trash bag is inserted into the container (1) and is stretched over the top rim (3), the snap-on lid (4) seals the contents within the bag. This design feature is especially important when the Easy Trash Bagger is used as a garbage can.
6. The adjustable handle (5) and wheels (6) allow the Easy Trash Bagger with its heavy and cumbersome filled bag to be pulled to the street curb where the bag is removed and left for disposal by trash haulers.
7. The back of the base rim (7) is notched. This design feature provides the following benefits: (a) it allows the Easy Trash Bagger to be level during trash loading because the base rim (2) and the bottom of the wheels (6) are on the same level, and (b) it prevents the back of the base rim (2) from rubbing against the ground when the Easy Trash Bagger is pulled by the adjustable handle (5).

FIG. 2 is a back view of the Easy Trash Bagger. The notch (7) in the back of the base rim is clearly seen.

FIG. 3 is a bottom view of the Easy Trash Bagger. The axle support (8) is mounted on the container's outer surface (1). This design feature provides the following benefits: (a) the wheels and axle do not interfere with the removal of the bag through the open base, and (b) the wide-track position of the wheels (6) increases the stability of the Easy Trash Bagger during the transportation of its contents.

Based on the above information, the Easy Trash Bagger is an improved yard maintenance tool used to bag yard trash in disposable plastic trash bags. It is a reusable trash container that supports the bag in an upright and open position for trash loading, protects the bag from tears and ruptures during trash loading and compaction, allows the easy removal of the heavy and cumbersome filled bag from the trash container, and transports the heavy and cumbersome filled bag to the street curb for disposal by trash haulers. Indoors, it may also be used to bag household garbage in a similar manner. While the Easy Trash Bagger has been described in detail, various modifications, alternations and changes may be made without departing from the spirit and scope of the invention as defined in the claim.

I claim:

1. A mobile trash and yard waste bagging device comprising:

a trash liner holder having a trash liner enclosing portion including an open ended frustro-conical shaped sleeve forming a sidewall for the holder, the sleeve includes an open top end with a top reinforcing rim having a first inner diameter and an open bottom end with a bottom reinforcing rim having a second inner diameter, the second diameter is approximately equal to the diameter of a trash bag liner and the first diameter is approximately one inch less than the second diameter, the height of the sidewall of the sleeve is a few inches shorter than the height of the trash bag liner;

an axle and wheels are attached to the exterior side of the sidewall of the sleeve adjacent the bottom end of the sleeve and defines a back side of the holder;

an adjustable handle is attached to the exterior sidewall of the sleeve adjacent the top end of the sleeve and the back side of the holder;

a lid is attached to the top reinforcing rim with a snap-acting latch securing the lid to the holder;

the bottom reinforcing rim is notched to provide accommodating space for the axle and wheels, to allow the sleeve to be level when trash is loaded, and to prevent the back side of the bottom rim from rubbing against the ground when the sleeve is pulled by the handle;

whereby a trash liner can be secured around the top rim of the sleeve and draped on the inside of the sleeve so that air can be expelled through the bottom of the sleeve as the trash liner is filled, a ground supporting surface will form a bottom support for the liner when the liner is being filled in a stationary and upright position and the trash liner holder can be moved by tilting the holder back upon the axis of the axle with the aid of the handle and moved about on its wheels by providing a pulling force upon the handle.

* * * * *